US007552701B2

(12) United States Patent
Brinkmann et al.

(10) Patent No.: US 7,552,701 B2
(45) Date of Patent: Jun. 30, 2009

(54) BOILER FOR MAKING SUPER HEATED STEAM AND ITS USE

(75) Inventors: Juergen Brinkmann, Gummersbach (DE); TeckSoon Lau, Amsterdam (NL); Hans Christian Thul, Gummersbach (DE)

(73) Assignee: Shell Oil Company, Houston, TX (US)

( * ) Notice: Subject to any disclaimer, the term of this patent is extended or adjusted under 35 U.S.C. 154(b) by 256 days.

(21) Appl. No.: 11/747,594

(22) Filed: May 11, 2007

(65) Prior Publication Data

US 2007/0283907 A1 Dec. 13, 2007

(51) Int. Cl.
*F22B 1/02* (2006.01)

(52) U.S. Cl. ..... 122/31.1; 122/7 R; 122/33; 122/467

(58) Field of Classification Search ..... 122/7 R, 122/15.1, 18.1, 31.1, 32, 33, 467, 483, 487
See application file for complete search history.

(56) References Cited

U.S. PATENT DOCUMENTS

| | | | | | |
|---|---|---|---|---|---|
| 3,788,281 | A | * | 1/1974 | Van Lookeren Campagne | 122/7 R |
| 3,867,907 | A | | 2/1975 | Marsch | 122/34 |
| 4,371,379 | A | * | 2/1983 | Brent et al. | 48/197 R |
| 4,462,339 | A | | 7/1984 | Jahnke et al. | 122/7 R |
| 4,488,513 | A | | 12/1984 | Jahnke et al. | 122/32 |
| 4,522,155 | A | * | 6/1985 | Vollhardt et al. | 122/7 R |
| 4,633,819 | A | * | 1/1987 | Tilliette | 122/32 |
| 4,721,065 | A | * | 1/1988 | Mohrenstecher et al. | 122/7 R |
| 4,732,590 | A | * | 3/1988 | McNeil | 96/419 |
| 5,228,413 | A | * | 7/1993 | Tam | 122/15.1 |

(Continued)

FOREIGN PATENT DOCUMENTS

| | | |
|---|---|---|
| BE | 570047 | 7/1961 |

(Continued)

OTHER PUBLICATIONS

Oil and Gas Journal, Sep. 6, 1971, pp. 85-90.

*Primary Examiner*—Gregory A Wilson

(57) ABSTRACT

A boiler for making super heated steam by indirect heat exchange of water against a hot gas, said boiler being a vertically oriented vessel comprising a spirally formed conduit around the vertical axis of the vessel, which vessel is provided with an inlet for hot gas fluidly connected to the lower end of the conduit for upwardly passage of hot gas through the spirally formed conduit, an outlet for cooled gas fluidly connected to the upper end of the conduit, an inlet for fresh water and a vessel outlet for super heated steam, said vessel further provided with a water bath space in the lower end of the vessel and a saturated steam collection space above said water bath space, said spirally formed conduit comprising of a spirally formed evaporating section located in the water bath space and a spirally formed super heater section at the upper end of the vessel, wherein the conduit of the super heater section is surrounded by a second conduit forming an annular space between said super heater conduit and said second conduit, said annular space being provided with an inlet for saturated steam fluidly connected to the saturated steam collection space and an outlet for super heated steam located at the opposite end of said annular space and fluidly connected to the vessel outlet for super heated steam, wherein outlet or inlet are positioned in water bath space.

10 Claims, 3 Drawing Sheets

U.S. PATENT DOCUMENTS

| | | | | |
|---|---|---|---|---|
| 5,233,943 | A * | 8/1993 | Martin et al. | 122/7 R |
| 5,357,906 | A * | 10/1994 | Brazier | 122/32 |
| 6,152,086 | A * | 11/2000 | Brouwer et al. | 122/249 |
| 6,435,139 | B1 * | 8/2002 | Brucher | 122/7 R |
| 2006/0065266 | A1 | 3/2006 | Saksena | 126/369 |

FOREIGN PATENT DOCUMENTS

| | | |
|---|---|---|
| EP | 2911111 | 11/1988 |
| WO | WO9603345 | 8/1996 |
| WO | WO9639354 | 12/1996 |
| WO | WO9722547 | 6/1997 |
| WO | WO00/06041 | 2/2000 |

* cited by examiner (A–A')

BOILER FOR MAKING SUPER HEATED STEAM AND ITS USE

This application claims the benefit of European application number 06114023.2 filed May 16, 2006 which is incorporated herein by reference.

FIELD OF THE INVENTION

The invention is directed to a boiler for making super heated steam by indirect heat exchange of water against a hot gas, a configuration comprising said boiler and to a process to prepare super heated steam.

BACKGROUND OF THE INVENTION

A boiler for making super heated steam is described in U.S. Pat. No. 3,867,907. In this apparatus a hot synthesis gas flows through tubular pipes, which are located in a water bath located at the lower end of a vertically oriented vessel. In said lower end saturated steam is generated. In the upper end of the vessel a conduit having a larger diameter than the tubular pipes surrounds said tubular pipes thereby defining an annular space around said pipes. The lower end of said annular space is open to receive saturated steam, which flows co-current with the hot syngas to the upper end of the vessel. At said upper end super heated steam and cooled synthesis gas are separately discharged from said vessel. The publication is especially directed to a protective cup around the inlet opening for saturated steam of the annular space.

A disadvantage of said design is that liquid water may enter the annular space, which will negatively affect the production of super heated steam. Another disadvantage is that local overheating at the inlet of the annular space may occur which will give rise to mechanical failure of the pipes. Because boilers of this type are designed to operate for years without failure any possible overheating due to the design should be avoided.

SUMMARY OF THE INVENTION

The present invention provides a boiler, which makes use of the effective heat transfer resultant from the annular space design of the boiler of U.S. Pat. No. 3,867,907 but at the same time avoids some of the disadvantages of said design.

The present invention provides a boiler for making super heated steam by indirect heat exchange of water against a hot gas, said boiler being a vertically oriented vessel comprising a spirally formed conduit around the vertical axis of the vessel, which vessel is provided with an inlet for hot gas fluidly connected to the lower end of the conduit for upwardly passage of hot gas through the spirally formed conduit, an outlet cooled gas fluidly connected to the upper end of the conduit, an inlet for fresh water and a vessel outlet for super heated steam, said vessel further provided with a water bath space in the lower end of the vessel and a saturated steam collection space above said water bath space, said spirally formed conduit comprising a spirally formed evaporating section located in the water bath space and a spirally formed super heater section at the upper end of the vessel, wherein the conduit of the super heater section is surrounded by a second conduit forming an annular space between said super heater conduit and said second conduit, said annular space being provided with an inlet for saturated steam fluidly connected to the saturated steam collection space and an outlet for super heated steam located at the opposite end of said annular space and fluidly connected to the vessel outlet for super heated steam, wherein outlet or inlet are positioned in water bath space.

In the boiler of the present invention, saturated steam may flow co-currently with the hot gas or counter-currently with the hot gas through the annular space. In a co-current embodiment, the inlet is placed in the water bath space. In a counter-current embodiment, the outlet is placed in the water bath space. By positioning respective inlet and outlet in the water bath space, local overheating of the walls of the spirally conduit is avoided.

In case of the co-current embodiment a separate supply conduit will preferably be present to supply saturated steam to inlet from the saturated steam collection space.

BRIEF DESCRIPTION OF THE DRAWINGS

The invention shall be illustrated making use of FIGS. 1-3.

DETAILED DESCRIPTION OF THE INVENTION

Figure 1:
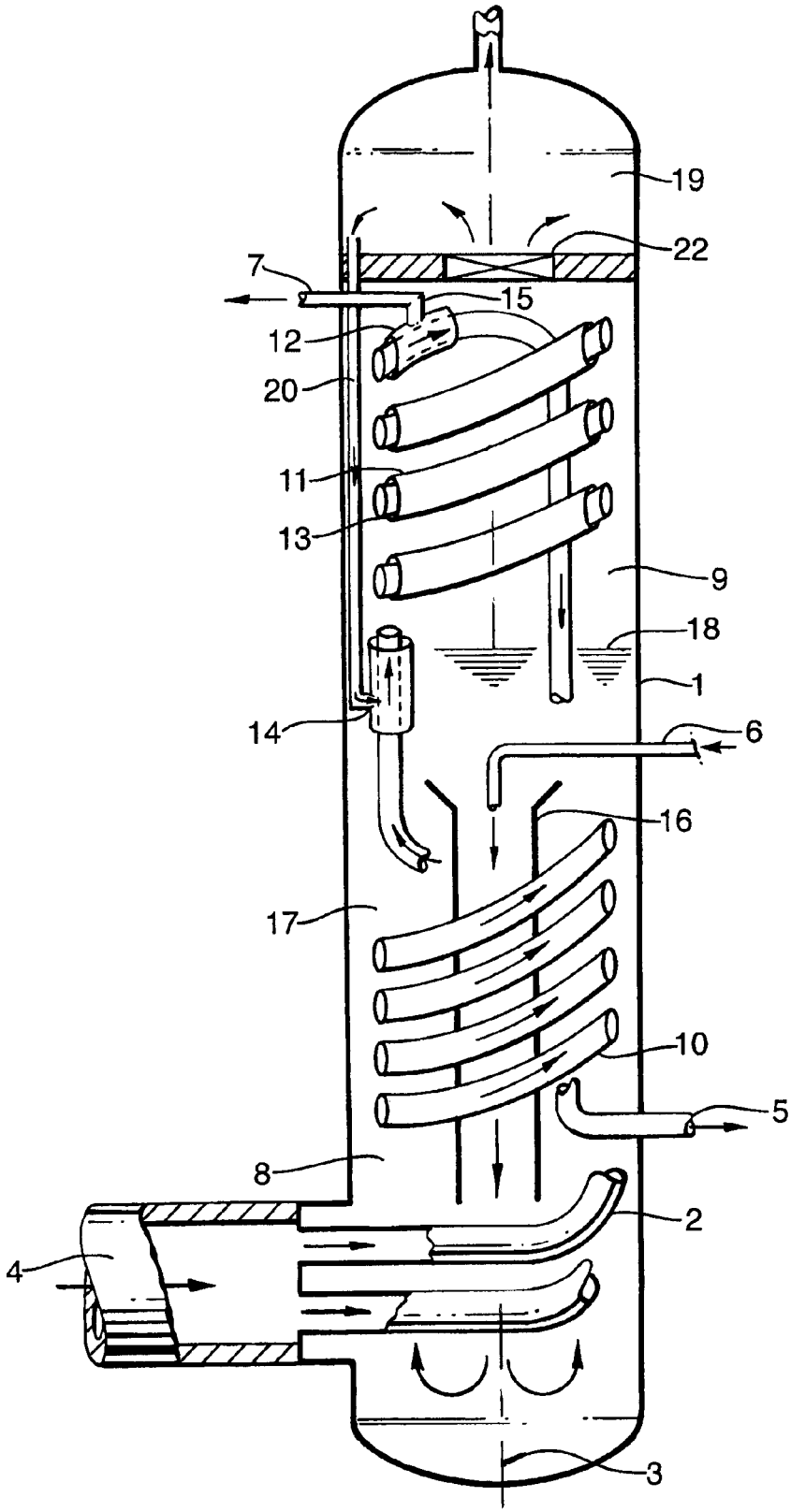
FIG. 1 is a boiler according to the invention in a co-current embodiment.

FIG. 1 illustrates a vertically oriented vessel 1 comprising a spirally formed conduit 2 around the vertical axis 3. Vessel 1 is provided with an inlet 4 for hot gas fluidly connected to the lower end of the conduit 2 for upwardly passage of hot gas through the spirally formed conduit 2. In the drawing only one spirally formed conduit 2 is shown. Generally from 2 up to and including 24 conduits 2 may run parallel in a vessel 1. Even higher number of conduits 2 may run parallel in vessel 1 if enough space is available.

Vessel 1 is further provided with a water bath space 8 in the lower end of the vessel 1 and a saturated steam collection space 9 above said water bath space 8.

FIG. 1 also shows an outlet 5 for cooled gas fluidly connected to the upper end of the conduit 2. In FIG. 1 the outlet 5 is positioned in the lower end of the vessel 1 such that some additional cooling may take place when passing the water bath space 8. Obviously this outlet 5 may also be positioned in the upper end of the vessel. Also shown is an inlet 6 for fresh water. This inlet is preferably positioned such that the direction of the flow as it enters the vessel 1 enhances the circulation of water in a downward direction through a preferred downcomer 16. Downcomer 16 is preferably an open ended tubular part as shown. An upward direction of the water through an annular space 17 between downcomer 16 and outer wall of the vessel 1 will then result.

The spirally formed conduit 2 comprises a spirally formed evaporating section 10 located in the water bath space 8 and a spirally formed super heater section 11 at the upper end of the vessel 1. With spirally formed is here intended a substantially spirally formed conduit which may comprise straight parts, e.g. vertical straight parts, such as connecting parts at the bottom end and top end as well as where the inlet 14 for saturated steam is positioned. The conduit 2 of the super heater section 11 is surrounded by a second conduit 12 forming an annular space 13 between said super heater conduit 2 and said second conduit 12. The annular space 13 is provided with an inlet 14 for saturated steam fluidly connected to the saturated steam collection space 9 and an outlet 15 for super heated steam located at the opposite end of said annular space 13. The outlet 15 is fluidly connected to the vessel outlet 7 for super heated steam. In FIG. 1 a preferred embodiment of the boiler according the invention is shown in which between the inlet 14 for saturated steam and the saturated steam collection space 9 a demister 22 is provided. Demister means 22 are well known in the art and are used to separate any liquid water droplets from the saturated steam before it enters annular space 13. The demister 22 preferably separates the steam collection space 9 from a demisted steam collection space 19 located at the top end of vessel 1 as shown in FIG. 1. The demister 22 may be a demister mesh as schematically illustrated, a vane pack or a swirl tube cyclone deck. A transport conduit 20 fluidly connects said space 19 with the inlet 14 for saturated steam located in water bath space 8. Because this location is below the water level 18 overheating of the walls of conduit 2 are avoided as much as possible. Also because of the co-current flow of the two gasses a further reduction of the maximum possible wall temperature is achieved.

Preferably the spirally formed super heater section is located substantially in the saturated steam collection space, more preferably more than 90% of the length of the second conduit 12 is located above water level 18.

The conduits 2 are preferably made of chromium-molybdenum steel or more preferably a nickel based metal alloy to avoid metal dusting if the boiler is used to cool a synthesis gas, i.e. a mixture of carbon monoxide and hydrogen. An example of a suitable nickel based metal alloy is Alloy 693 as obtainable from Special Metals Corporation, USA.

Figure 2:
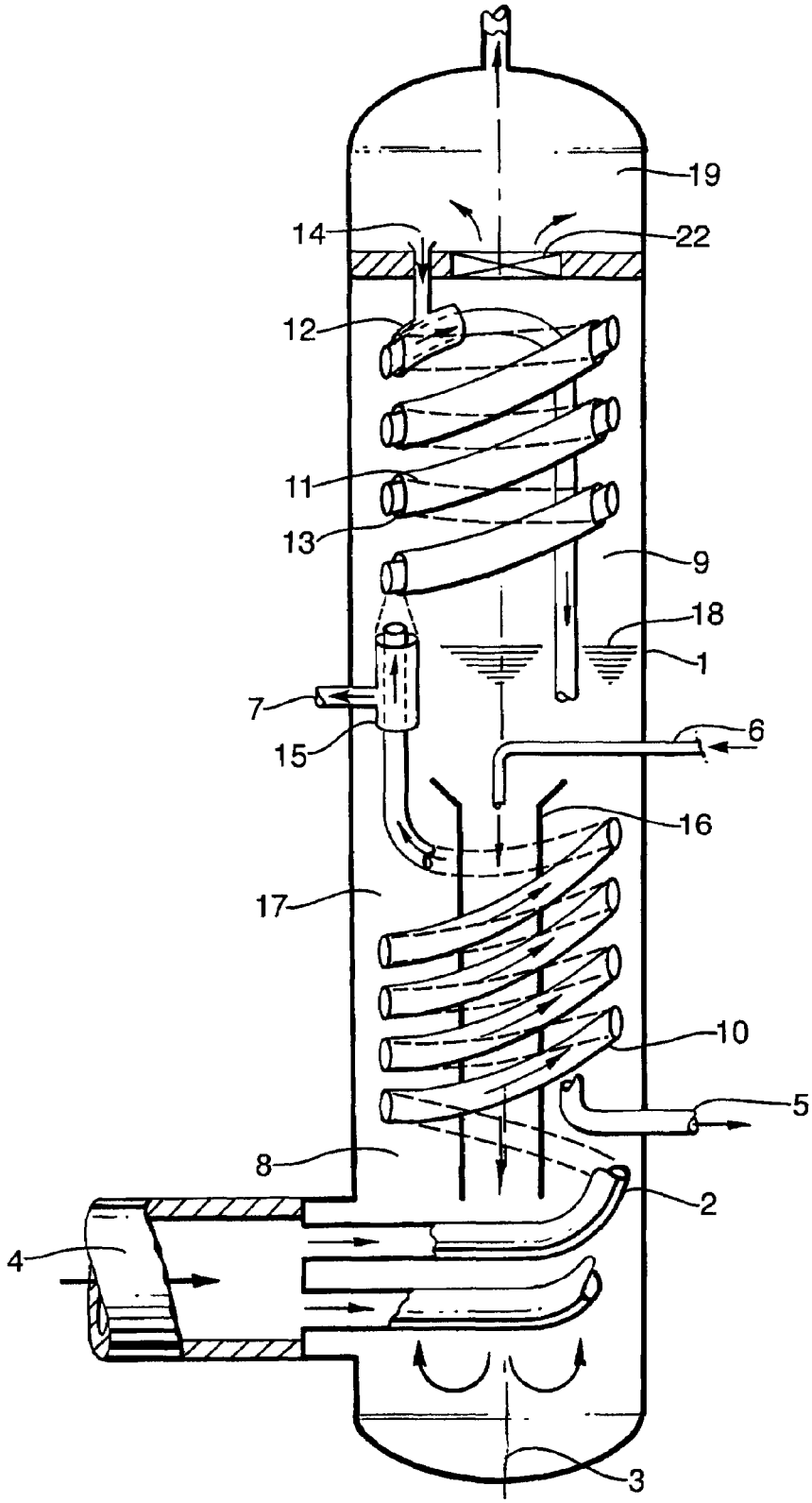
FIG. 2 is a boiler according to the invention in a counter-current embodiment.

FIG. 2 is a boiler according to the invention in a counter-current embodiment. This embodiment is preferred because it will provide the most efficient cooling of the hot gas in combination with the most efficient production of super heated steam. Most of the numerical references are as in FIG. 1 and will not be separately described at this point. The boiler of FIG. 2 differs from the one of FIG. 1 in the position of inlet 14 and outlet 15. In FIG. 2 the inlet for saturated gas of annular space 13 is provided at the downstream end of the super heater conduit section 11 as seen from the direction of the hot gas, such that in use the saturated steam flows counter-current in the annular space 13 relative to the hot gas in the spirally formed conduit 2 of super heater conduit section 11. Also shown in FIG. 2 is how outlet 15 of the super heated gas is connected to the vessel outlet for super heated gas 7 as located in water bath space 8. Because this location is below the water level 18 overheating of the walls of conduit 2 are avoided as much as possible.

FIG. 2 shows dotted lines to illustrate how conduit 2 runs spirally through vessel 1.

Figure 3A:
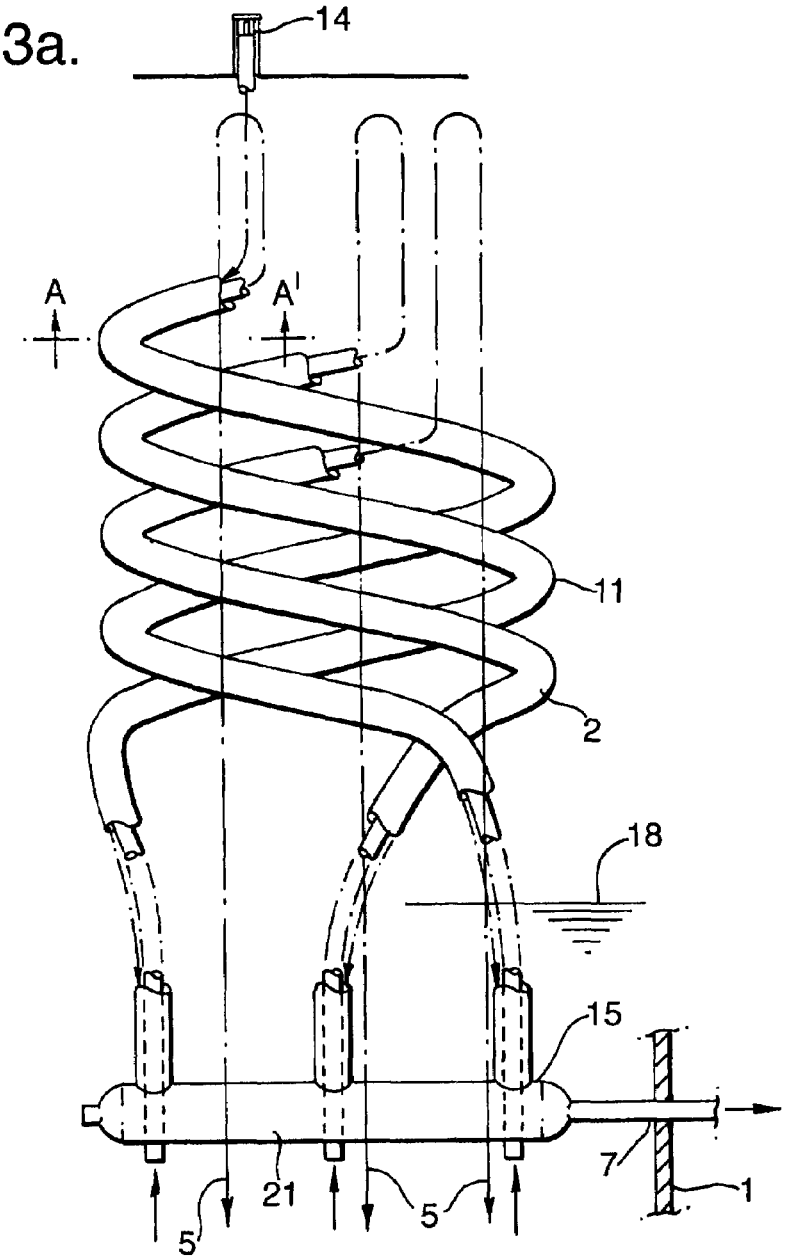
FIGS. 3*a* and 3*b* shows the super heater section of the boiler according to FIG. 2.

FIG. 3*a* shows the super heater section 11 of conduit 2, an inlet for saturated steam 14, and three conduits 2 which run in a vertical direction through a common header 21. This common header 21 is in fluid communication with annular space 13 surrounding the three conduits 2 via outlet openings 15. In turn the common header 21 is fluidly connected to the vessel outlet 7 for discharge of super heated steam from vessel 1 of which part of the wall is shown. The common header 21 is preferably circular in a horizontal plane to accommodate efficiently the numerous conduits 2 which may run parallel in vessel 1.

Figure 3B:
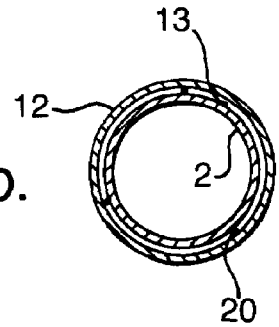

FIG. 3*b* shows a cross sectional view along AA' of FIG. 3*a*. In FIG. 3*b* conduit 2, annular space 13 and second conduit 12 are shown. Additionally preferred spaces elements 20 are shown to ensure that an annular space is present.

Preferably the boiler according to the present invention is used for the process to prepare super heated steam using a hot gas. Preferably the temperature of the hot gas entering the conduit 2 is between 700 and 1600° C., more preferably between 1000° C. and 1600° C. The pressure of the hot gas is suitably between 2 and 11 MPa. The cooled gas as it leaves the vessel 1 preferably has a temperature of below 600° C. and more preferably between 200 and 450° C.

The temperature of fresh water provided via inlet 6 is preferably between 5 and 100° C. lower in temperature than the saturation temperature of water at the operating pressure of the boiler. With operating pressure of the boiler is meant the pressure of the saturated steam in saturated steam collection space 9. Preferably the pressure of the super heated steam as prepared is between 2 and 15 MPa and more preferably between 4 and 15 MPa.

The hot gas may be any hot gas. Applicants have found that the apparatus and process is very suited to cool hot gasses comprising carbon monoxide and hydrogen and maintain the skin temperature of the surfaces of conduit 2 to a value of below 500° C. This is advantageous because exotic materials can thus be avoided and/or the process can be performed with such a hot gas comprising very little sulphur. Applicants found that the process may be performed with a hot gas comprising carbon monoxide and hydrogen and between 0 and 3 vol % sulphur, preferably between 0 and 100 ppmv sulphur and even more preferably between 0 and 50 ppmv.

The invention is also directed to a process to prepare a mixture of carbon monoxide and hydrogen by means of a catalyzed or preferably non-catalyzed partial oxidation (POX) of a hydrocarbon feed or alternatively by means of an auto-thermal reforming step (ATR) of natural gas, wherein the carbon monoxide and hydrogen as prepared are reduced in temperature using the boiler according to the present invention.

The hydrocarbon feed of a POX may be a gaseous fuel or a liquid fuel. Examples of possible feedstocks include natural gas, fractions obtained from (hydro-processed) tar sand sources and refinery streams such as middle distillates and more preferably fractions boiling above 370° C., such as those obtained in a vacuum distillation column. Examples are the vacuum distillates and the residue as obtained by a vacuum distillation of the 370° C. plus fraction as obtained when distilling a crude petroleum feedstock or when distilling the effluent of a carbon rejection process as performed in a refinery. Examples of carbon rejection processes are the well known fluid catalytic cracking (FCC) process, thermal cracking and the vis-breaking process. The hot gas as obtained in a gasification process will comprise mainly carbon monoxide and hydrogen.

A preferred feed for the POX is a gaseous hydrocarbon, suitably methane, natural gas, associated gas or a mixture of $C_{1-4}$ hydrocarbons. Examples of gaseous hydrocarbons are natural gas, refinery gas, associated gas or (coal bed) methane and the like. The gaseous hydrocarbons suitably comprise mainly, i.e. more than 90 v/v %, especially more than 94%, $C_{1-4}$ hydrocarbons, especially comprise at least 60 v/v percent methane, preferably at least 75 percent, more preferably 90 percent. Preferably natural gas or associated gas is used.

The POX may be performed according to well known principles as for example described for the Shell Gasification Process in the Oil and Gas Journal, Sep. 6, 1971, pp. 85-90. Publications describing examples of partial oxidation processes are EP-A-291111, WO-A-9722547, WO-A-9639354 and WO-A-9603345. In such processes the feed is contacted with an oxygen containing gas under partial oxidation conditions preferably in the absence of a catalyst.

The oxygen containing gas may be air (containing about 21 percent of oxygen) and preferably oxygen enriched air, suitably containing up to 100 percent of oxygen, preferably containing at least 60 volume percent oxygen, more preferably at least 80 volume percent, more preferably at least 98 volume percent of oxygen. Oxygen enriched air may be produced via cryogenic techniques, but is preferably produced by a membrane based process, e.g. the process as described in WO 93/06041.

Contacting the feed with the oxygen containing gas is preferably performed in a burner placed in a reactor vessel. To adjust the $H_2/CO$ ratio in the gaseous product obtained in the partial oxidation reaction, carbon dioxide and/or steam may be introduced into the feed. The gaseous product of the partial oxidation reaction preferably $H_2/CO$ molar ratio of from 1.5 up to 2.6, preferably from 1.6 up to 2.2.

The invention is also directed to a configuration of a partial oxidation reactor and the above described boiler, wherein the reactor is provided with a burner, supply conduits to said burner to supply a hydrocarbon feed and an oxidation gas, said reactor also provided with an outlet for the partial oxidized gas which outlet is fluidly connected to an inlet for hot gas of the boiler.

The mixture of carbon monoxide and hydrogen as obtained by the above process may advantageously be used as feedstock for power generation, hydrogen manufacture, a Fischer-Tropsch synthesis process, methanol synthesis process, a dimethyl ether synthesis process, an acetic acid synthesis process, ammonia synthesis process or other processes which use a synthesis gas mixture as feed such as for example processes involving carbonylation and hydroformylation reactions.

The super heated steam is preferably used to generate power, for example in a steam turbine or as a mechanical drive in for example pumps, compressors and other utilities as may be present in the vicinity of the boiler.

What is claimed is:

1. A boiler for making super heated steam by indirect heat exchange of water against a hot gas, said boiler comprising a vertically oriented vessel comprising a spirally formed conduit around a vertical axis of the vessel, which vessel is provided with an inlet for hot gas fluidly connected to a lower end of the conduit for upwardly passage of hot gas through the spirally formed conduit, an outlet for cooled gas fluidly connected to the upper end of the conduit, an inlet for fresh water and a vessel outlet for super heated steam, said vessel further provided with a water bath space in the lower end of the vessel and a saturated steam collection space above said water bath space, said spirally formed conduit comprising a spirally formed evaporating section located in the water bath space and a spirally formed super heater section at the upper end of the vessel, wherein the conduit of the super heater section is surrounded by a second conduit forming an annular space between said super heater conduit and said second conduit, said annular space being provided with an inlet for saturated steam fluidly connected to the saturated steam collection space and an outlet for super heated steam located at the opposite end of said annular space and fluidly connected to the vessel outlet for super heated steam, wherein outlet or inlet are positioned in water bath space.

2. A boiler according to claim 1, further comprising a demister between the inlet for saturated steam and the saturated steam collection space.

3. A boiler according to claim 1, wherein the spirally formed super heater section is located in the saturated steam collection space.

4. A boiler according to claim 1, wherein the inlet for saturated steam is provided at the upstream end of the super heater conduit section as seen from the direction of the hot gas, such that in use the saturated steam flows co-current in the annular space relative to the hot gas in the spirally formed conduit.

5. A boiler according to claim 1, wherein the inlet for saturated steam is provided at the downstream end of the super heater conduit section as seen from the direction of the hot gas, such that in use the saturated steam flows counter-current in the annular space relative to the hot gas in the spirally formed conduit.

6. A boiler according to claim 5, wherein the spirally formed super heater section comprises at least 2 spirally formed conduits running parallel relative to each other and wherein the outlet of the annular space of each conduit is fluidly connected to a common header, said common header being in the form of a horizontal ring through which the conduits transfer in a vertical direction, thereby forming annular outlet openings for passage of the super heated steam to enter the common header and wherein the common header is fluidly connected to the vessel outlet for super heated steam.

7. A boiler according to claim 1, wherein the spirally formed super heater section is located in the saturated steam collection space, the upper end of the saturated steam section is provided with a demister which separates the upper end of the vessel in a saturated steam collection space and a demisted saturated steam collection space and wherein the inlet for saturated steam is provided in the demisted saturated steam collection space.

8. A boiler according to claim 1, further comprising a partial oxidation reactor wherein the reactor is provided with a burner, supply conduits to said burner to supply a hydrocarbon feed and an oxidation gas, said reactor also provided with a outlet for the partial oxidized gas which outlet is fluidly connected to inlet for hot gas of the boiler.

9. A process to prepare super heated steam in a boiler according to claim 1, wherein the hot gas has at inlet 4 a temperature of between 700 and 1600° C. and a pressure of between 2 and 11 MPa, the cooled gas at outlet 5 has a temperature of between 200 and 450° C. and the pressure of the super heated steam at outlet 7 has a pressure of between 2 and 15 MPa.

10. A process according to claim 9, wherein the hot gas comprises carbon monoxide and hydrogen and between 0 and 3 vol % sulphur.

* * * * *